US011031155B2

(12) United States Patent
Nardelli et al.

(10) Patent No.: US 11,031,155 B2
(45) Date of Patent: Jun. 8, 2021

(54) REINFORCED SUPERCONDUCTING WIRE, SUPERCONDUCTING CABLE, SUPERCONDUCTING COIL AND SUPERCONDUCTING MAGNET

(71) Applicant: Bruker Switzerland AG, Faellanden (CH)

(72) Inventors: Davide Nardelli, Volketswil (CH); Matteo Alessandrini, Opfikon (CH)

(73) Assignee: BRUKER SWITZERLAND AG, Faellanden (CH)

( * ) Notice: Subject to any disclaimer, the term of this patent is extended or adjusted under 35 U.S.C. 154(b) by 0 days.

(21) Appl. No.: 16/844,032

(22) Filed: Apr. 9, 2020

(65) Prior Publication Data

US 2020/0328013 A1 Oct. 15, 2020

(30) Foreign Application Priority Data

Apr. 9, 2019 (EP) ..... 19168191

(51) Int. Cl.

| | |
|---|---|
| ***H01B 12/00*** | (2006.01) |
| ***H01B 13/26*** | (2006.01) |
| ***H01B 12/08*** | (2006.01) |
| ***H01B 7/18*** | (2006.01) |
| ***H01B 12/06*** | (2006.01) |

(52) U.S. Cl.

CPC ..... *H01B 12/08* (2013.01); *H01B 7/1855* (2013.01); *H01B 7/1865* (2013.01); *H01B 12/06* (2013.01); *H01B 13/26* (2013.01)

(58) Field of Classification Search

CPC ..... H01B 12/00; H01B 12/02; H01B 12/04; H01B 12/06; H01B 12/08; H01B 12/10; H01B 12/12; H01B 13/26–2693; Y10T 29/41014; Y10S 505/884–887

See application file for complete search history.

(56) References Cited

U.S. PATENT DOCUMENTS

| | | | |
|---|---|---|---|
| 2,111,409 | A | 6/1936 | Seaberg |
| 3,365,538 | A | 1/1968 | Voigt |

(Continued)

FOREIGN PATENT DOCUMENTS

| | | | |
|---|---|---|---|
| CN | 1658343 | A | 8/2005 |
| CN | 203787146 | U | 8/2014 |

(Continued)

OTHER PUBLICATIONS

Watanabe et al., "Ag-Sheathed Bi2Sr2CaCu208 Square Wire Insulted With Oxidized Hastelloy Fiber Braid" (2008), 8 pages.

*Primary Examiner* — Jeremy C Norris

(74) *Attorney, Agent, or Firm* — Edell, Shapiro & Finnan, LLC

(57) ABSTRACT

A reinforced superconducting wire (1*a*) has a superconducting core strand (2) and a first cladding with a multitude of reinforcing strands (3). The reinforcing strands (3) are arranged around the circumferential surface of the superconducting core strand (2) in a non-crossing manner and are in contact with the core strand (2). The wire has a reinforcement for enhancing its mechanical properties against external stresses and for preventing diameter expansion during heat treatment. In addition to other advantages, such superconducting wire can be produced with an easy and low-cost production process.

22 Claims, 3 Drawing Sheets

(56) References Cited

U.S. PATENT DOCUMENTS

| | | | | |
|---|---|---|---|---|
| 3,730,966 | A * | 5/1973 | Aupoix | H02H 7/001 174/15.5 |
| 4,646,428 | A * | 3/1987 | Marancik | H01L 39/2409 148/536 |
| 5,214,243 | A | 5/1993 | Johnson | |
| 5,593,524 | A | 1/1997 | Philips | |
| 5,796,043 | A | 8/1998 | Maruyama | |
| 6,534,718 | B1 | 3/2003 | Pourrahimi et al. | |
| 2003/0184929 | A1* | 10/2003 | Miura | H01F 6/06 361/19 |
| 2004/0055780 | A1 | 3/2004 | Hakkarainen et al. | |
| 2006/0048966 | A1* | 3/2006 | Takahashi | H01B 11/1025 174/108 |
| 2014/0296077 | A1 | 10/2014 | Shen | |

FOREIGN PATENT DOCUMENTS

| | | | |
|---|---|---|---|
| CN | 108711472 | A | 10/2018 |
| JP | H10188690 | A | 7/1998 |

* cited by examiner

REINFORCED SUPERCONDUCTING WIRE, SUPERCONDUCTING CABLE, SUPERCONDUCTING COIL AND SUPERCONDUCTING MAGNET

CROSS REFERENCE TO RELATED APPLICATIONS

This application claims foreign priority under 35 U.S.C. § 119(a)-(d) to European Patent Application EP 19 168 191.5 filed on Apr. 9, 2019, and the contents of which are incorporated into the present application by reference in their entirety.

FIELD OF THE INVENTION

The invention concerns a reinforced superconducting wire with a superconducting core strand and a first cladding comprising a single reinforcing strand or a multitude of in particular non-superconducting reinforcing strands. The invention further concerns a superconducting cable, a superconducting coil and a superconducting magnet.

BACKGROUND

A reinforced superconducting strand is known from [01].

Superconducting magnets with coils of superconducting wires are widely used, e.g. in magnet resonance applications. Due to the magnetic interaction between the current in the superconducting wire and the magnetic field in a charged superconducting magnet, strong forces (Lorentz force) tend to compress the coil axially (axial stress) and radially (radial stress) and pull it tangentially (hoop stress). The latter component is generally the most impacting one. The wound superconducting wire, or a structure comprised in the coil, must withstand all these forces without damage and in particular must not impair the electrical transport properties of the wire.

This is particularly challenging for high/ultra-high magnetic fields magnets, where high stress is generated and where the available technical superconducting conductors are the weakest: apart from REBCO (Rare-earth barium copper oxide) tape, conductors of Nb3Sn (Niobium tin), BSCCO 2223, BSCCO 2212 (Bismuth strontium calcium copper oxides) are all brittle and not mechanically supported (i.e., are not structurally self-supporting). Moreover, some of these wires (Nb3Sn and BSCCO 2212) must be heat treated at high temperature (600-900° C.) after winding.

Specifically, Bi2212 wires are subjected to another mechanical stress: Bi2212 wires tend to increase in diameter by releasing internal gases during heat treatment, creating internal pressure at high temperatures. At weak points of the superconducting wire or at gas concentration points in the superconducting wire, the internal pressure can cause the wire to break.

In order to reinforce superconducting cables, it is known to add a reinforcement sheathing around a multitude of superconducting strands [03], [04], [05], [06], [07]. A reinforced superconducting coil is known from [10]. Although a reinforcement of the cable and coil respectively is achieved, radial expansion of the superconducting strands cannot be prevented with said methods.

[03] proposes a reinforcement method in which a double protective oxide layer insulates a high-strength alloy strand and a protective oxide layer insulates a superconducting strand. The insulated high-strength alloy strand and the insulated superconducting strand are then composed to form a reinforced cable. However, the described cabling is complicated since the reinforcing strands must be positioned in an exact configuration with respect to the superconducting strands in the cabling. Furthermore, providing a separate insulated high-strength alloy strand and pre-oxidation of the superconducting strands require a complex manufacturing process. It is not possible to split the longitudinal and radial reinforcement. Thus, the method known from [03] does not enable to tune the reinforcement capability according to the specific application requirements.

[09] describes a high-tension cable comprising a metallic wire wound around a reinforcing core. An insulator covers the metallic wire. However, the wiring of superconducting strands around a hightension cable is not feasible since a small bending diameter can damage the strands and larger bending diameter results in very large cable diameters. Furthermore, coiling a superconducting strand around the reinforcing core would be either really inefficient (tight winding around the wire would cause the wire to travel a much longer path) or geometrical inhomogeneous (in case the superconducting strand is wound around the reinforcing strand more loosely).

[02] discloses an Ag-sheathed Bi2212 strand. A braid of Hastelloy® fibers surrounds the Ag-sheathed Bi2212 strand, which are heat treated and oxidized. The surrounding braid is intended for insulation purposes. Yet, the reinforcement of the braided wires is weak: due to the braiding, the fibers cross each other in countersense. The continuous bending associated with the braiding generates only a slightly compact structure, which allows some "elastic" behavior and is thus mechanically less efficient. Moreover, the disclosed braided structure is not able to prevent radial expansion of the wire.

[08] discloses a conductor with an insulation layer encircling the conductor and a mesh tape applied over the insulation layer for reinforcing the conductor. This means, however, that the external insulation increases the thickness of the wire, which in turn results in loss of conducting material efficiency and a material that is not able to withstand high temperatures.

[01] discloses a superconducting strand made of filamentary NbTi or Nb3Sn within a copper matrix. The superconducting strand is sheathed with a tube/foil of the reinforcing stainless-steel material and is cold-worked afterwards in order to put the reinforcement foil into contact with the superconducting strand. Yet, this method is very hard to implement in a production process because the structure has an additional material with large mechanical differences that usually requires additional intermediate heat treatments that are not compatible with the superconductor itself. In addition, a thin reinforcement layer is usually required (and desired) that does not take up additional space where other (current carrying) conductors could be placed. However, when processing a composite wire as described in [01], if the reinforcing material is too thin, the external material tends to break easily during cold forming, resulting in scrapped production.

SUMMARY

It is an object of the invention to provide a superconducting wire having a reinforcement for enhancing its mechanical properties against external stresses and for preventing diameter expansion during heat treatment. It is a further object to produce such a superconducting wire with an easy and low-cost production process. It is yet another object to provide a method for producing such a superconducting wire.

DESCRIPTION OF THE INVENTION

This object is achieved by a reinforced superconducting wire, a superconducting cable, a superconducting coil, a superconducting magnet, and a method for producing such a reinforced superconducting wire as claimed in the appended claims.

A "superconducting wire" or, in general, a "superconducting device" such as magnet, cable, etc., is referred to as a wire, magnet, cable, etc., which already contains a superconducting material or which contains precursors of the superconducting material, so that, after a thermal treatment, they become the superconducting material.

In the following, reinforcing strands also comprises embodiments with one reinforcing strand.

According to the invention, the reinforcing strands are arranged around the circumferential surface of the superconducting core strand in a non-crossing manner, wherein the reinforcing strands are in contact with the core strand.

The superconducting core strand to be reinforced can be a single solid core of superconducting material or a multicore of superconducting material with several superconducting-filaments in a matrix. The superconducting material of core strand can be, e.g., Nb3Sn, BSCCO2223, BSCCO2212.

The reinforcing strands of the first cladding are attached to the core strand. The core strand together with the reinforcing strands (and if necessary further claddings, isolation etc.) form the reinforced superconducting wire.

According to the invention, the reinforcing strands are in contact with the core strand, i.e. the surfaces between the cladding and the core strand touches each other and there is no additional layer between reinforcing strands and core strand, thereby keeping the wire compact. Yet, the first cladding is not in "intimate" physical/chemical contact with the core strand. To be "not in intimate physical/chemical contact" means that the atoms are not in a metallic/chemical ligand, which means that they do not form a coordination complex. Thus, the surfaces between the cladding and the core strand touches each other (and can be also in close contact) but there is not a continuity in the materials (like soldered or fused together by soldering, melting, high pressure mechanical contacting).

According to the invention, several reinforcing strands are distributed over the circumference of the core strand. The first cladding may comprise areas in which the reinforcing strands of the first cladding are separated from each other. In other words, the reinforcing strands do not need to be tightly packed and the reinforcing strands do not have to touch each other over their entire length. This is, for example, the case when the diameter of the strands of the first cladding is such that they are not able to completely cover the circumference, so they are randomly touching/not touching each other.

The first cladding is attached to/held in contact with the core strand by spiral winding of the reinforcement strands around the core strand and/or by providing a further cladding as will be described below.

The material of the reinforcing strands is selected to achieve specified mechanical properties required by the final use of the superconducting wire. For example, if a certain pressure/force is required to be sustained, the reinforcing materials and their dimensions are selected to withstand this pressure/force. The reinforcing strands of the first cladding are preferably made from metal wires or carbon fibers. Preferably, the reinforcement fibers are arranged in a non-crossing manner (i.e., so as not to overlap with one another). The reinforcement strands may also provide support against radial compression from the outside to the inside and expansion from the inside to the outside of the core strand.

The reinforcing strands of the first cladding are arranged in linear paths. Preferably, the reinforcing strands of the first cladding are arranged parallel to each other. Thus, a maximum number of reinforcing strands can be positioned around the core strand without crossing (i.e., without overlapping) each other.

The reinforcing strands are aligned along the core strand at an angle $\alpha$ to the core strand.

In one embodiment the reinforcing strand/s is/are wound spirally around and along the core strand, i.e. the reinforcing strand/s make/s at least one full rotation around the circumferential surface of the core strand of length L.

In principle, reinforcement is achieved at any angle $\alpha$. However, the more the reinforcement strands are aligned in the direction of the core strand, i.e. the smaller the angle $\alpha$, the more efficient the reinforcement is against longitudinal stress. Therefore, it is preferred to choose $\alpha \leq 10°$, in particular $\alpha \leq 5°$, most preferred $\alpha = 0°$, where the reinforcing strands run parallel to the core strand. An angle $\alpha = 0°$ results in a maximum longitudinal reinforcement. Nevertheless, a small angle $\alpha \neq 0$ can also results in sufficient longitudinal reinforcement. If the focus is more on radial reinforcement, a larger angle $\alpha$ can be selected.

In a preferred embodiment, the diameter of the reinforcing strands of the first cladding is smaller, in particular less by a factor 1.1, preferably less by a factor 10, than the diameter of the superconducting strand. The smaller the diameter of the reinforcement strands the more reinforcement strands can be attached to the core strand and the smaller is the diameter of the resulting superconducting wire. Since the reinforcement required to achieve the required mechanical strength can usually be achieved with a relatively thin reinforcement layer around the conductor, the diameter of the reinforcement wires is preferably select smaller than the diameter of the superconducting core strand in order to obtain a compact wire.

The first cladding can be attached to the core strand by coiling. Yet an angle of $\alpha \neq 0°$ is required then.

In a highly preferred embodiment of the inventive superconducting wire, the wire comprises at least one further cladding surrounding the first cladding, wherein the further cladding comprises further strands, which are oriented obliquely to the reinforcing strands of the first cladding. The further cladding helps keeping the first cladding in correct position around the core strand (even at small alignment angles $\alpha$ of the first reinforcement strands) and may provide further reinforcement. Accordingly, the further strands of the further cladding may be made of reinforcing materials (like steel, metals, metal fibers, ceramic fibers, or carbon fibers etc.) or of weaker materials (like fiberglass), but which are strong enough to hold the reinforcing strands of the first cladding in position along the core strand. If the further cladding comprises strands of reinforcing material, it reinforces the core strand radially (radial reinforcement). The further strands of the further cladding may be braided, twisted, or woven or (preferred) wound onto the first cladding.

The further strands are preferably oriented at an angle $\beta$ to the superconducting core strand, with $\beta > \alpha$. Due to the different angles $\beta$ of the further strands compared to the alignment angle $\alpha$ of the reinforcement strands, the further cladding is able to efficiently hold the first cladding in position around the core strand. Further, the angle β between the further strands and the core strand influences the radial reinforcement: The closer the angle β between further cladding and core strand gets to 90°, the higher is the effect of radial reinforcement.

The material of the first cladding may be different of the material of the further cladding. The cross sectional dimensions (diameter, cross sectional area) of the further strands of the further cladding can be different from those of the reinforcing strands of the first cladding.

In a special embodiment of the superconducting wire, the first cladding comprises reinforcing strands of different cross sectional dimensions and/or the further cladding comprises further strands of different cross sectional dimensions. By providing strands of different dimensions, the radial and longitudinal reinforcements, for example, can be tuned according to the specific requirements.

In a special embodiment, an external electrical insulation can be provided surrounding the further cladding. The insulation can be made of oxides, carbon, or other semiconducting or insulating composites. The insulation is preferably made of fibers and/or wires. The material of the insulation can be rubber, plastic or other standard insulating material used for standard electrical cable/wire insulation.

In another special embodiment the wire and/or the reinforcing strands is/are impregnated with glues, resins or paraffins. Impregnation provides further enhancement of the mechanical strength, because of the intimate contact and collaborative mechanical strength between the inventive reinforcing technology and the impregnating material. The impregnation process can be carried out after sheathing the core strand with the cladding(s), or also after the wire is prepared to be used in the final appliance (e.g.: after it is wound in coils).

In order to increase reinforcement, a metal mesh can be provided between the claddings of the wire or externally to the product (magnet, cable, etc.) in which the wire is built in. Such an additional reinforcement mesh is in particular advantageous if the superconducting wire or the respective product it is impregnated, since the impregnating material tends to fix the wires of the mesh one to the other.

The invention also concerns a superconducting cable comprising at least two superconducting wires as described above. A number of superconducting wires are cabled together to form a multi-wire conductor (superconducting cable), e.g. by twisting the superconducting wires. Thus, an increased electrical current can be carried in a single cable. According to the invention, the superconducting wires of the superconducting cable are individually reinforced prior to cabling by attaching the reinforcing strands to the core strand in direct contact with the core strand.

The invention also concerns a superconducting coil comprising a superconducting cable or a superconducting wire as described above. In particular, a solenoid coil can be formed with the superconducting wire and superconducting cable respectively.

The invention also concerns a superconducting magnet comprising a superconducting coil as described above. Due to the inventive reinforcement, the inventive coil can withstand stronger forces during operation of the magnet without damage.

The invention also concerns a method for producing a reinforced superconducting core wire as described above, comprising the following steps:

a) producing a superconducting core strand, b) sheathing the core strand with a first cladding.

According to the invention, step b) comprises attaching plural, e.g. a multitude of, reinforcing strands to the superconducting core strand around the circumferential surface of the superconducting core strand in a non-crossing manner, wherein the reinforcing strands are brought in contact with the core strand.

According to the invention, the first cladding is attached to the core strand in a post-processing step, i.e. after the production of the superconducting strand. Thus, the reinforcing process does not complicate the production of the bare core strand, because it does not add other materials to deformation processes (drawing, rolling, etc.) required to form a superconducting strand. Composite assemblies, difficult to be deformed because of different mechanical properties of the materials, are avoided. The post processing reinforcement gives freedom of choosing the reinforcement for different customers/applications/timings on the same basic bare wire already produced and, e.g., put in the warehouse.

In a preferred embodiment, the first cladding is formed by spirally winding the reinforcing strands around the circumferential surface of the superconducting core strand. Spiral winding of the reinforcement strands enables fixing the first cladding to the core strand without providing a further cladding. The reinforcing strands are preferably aligned parallel to each other. Thus, a maximum number of reinforcing strands can be placed around the core strand, thereby maximizing the lateral reinforcement, without the reinforcing strands crossing each other. By preventing the wires from crossing, the elasticity of the cladding is minimized and radial reinforcement is increased.

In order to achieve maximum longitudinal reinforcement, the first cladding is formed by aligning the reinforcing strands along the core strand parallel or nearly parallel to the superconducting core strand, i.e. at an angle α to the superconducting core strand no greater than 10°, in particular no greater than 5°, preferably at an angle α=0. Since a small angle α between the core strand and the reinforcing strands ensures greater longitudinal reinforcement, it is preferred to align the reinforcing strands around the circumference of the core strand essentially along the superconducting strand. Yet, a slight misalignment (reinforcing strands not exactly parallel to the core strand) is uncritical to the reinforcement effect and allows twisting the reinforcement strands around the core strand. In the extreme case of a very small angle α the reinforcing strands may make less than a full rotation around the circumferential surface of the core strand of length L. In this case fixation, e.g. by a further cladding is required.

In case the reinforcing strands are aligned parallel or essentially parallel to the core strand the reinforcing strands are preferably kept under pretension during forming the first cladding (and if applicable a further cladding). The first cladding can be attached to the superconducting core strand by keeping the superconducting core strand in tension between an origin conductor spool and an accumulating conductor spool. Then, there are other "n" spools with the other reinforcing wires, disposed around the conductor spools. Each beginning of reinforcing wire of each spool is pulled and kept in tension (by breakers on the spools axis) around the core strand on the circumference. In this way, the wires are parallel to and distributed around the circumference of the core strand. To push the reinforcing wires close to the surface of the core strand, a drawing die can be used with an internal hole diameter slightly larger than the sum of diameter of the core strand and two times the diameter of the reinforcing wires. Therefore, the assembly of core strand in the middle and the surround reinforcement wires are forced to pass into the die, such in a way that they are pushed all closer one to the other. After the die, the core strand and the reinforcing wires are aligned and close to each other. Now, the second layer of jacketing can be applied, as it works both for reinforcing and/or insulating and for keeping the first layer of cladding wires in the correct position (i.e.: aligned and close to the surface of the core strand).

In order to keep the first cladding in position, it is highly preferred that the circumferential surface of the first cladding is jacketed with at least one further cladding, wherein the further cladding comprises at least one further strand. This results in a final simply self-reinforced wire that can be readily wound into coils, reacted at high temperatures if required, and then impregnated, if required. This eliminates the need for more complicated, expensive and less reliable pre- or post-processing technologies (such as gluing or soldering reinforcing strips or other materials/shapes to the core strand).

The further cladding may be formed by twisting, braiding or woven of the at least one further strand over the first cladding. The further strands run in different directions, wherein at least some of the further strands are oriented obliquely with respect to the reinforcing strands of the first cladding.

Alternatively, the further cladding can be formed by spirally winding the at least one further strand around the circumferential surface of the first cladding.

Further advantages of the invention can be derived from the description and the figures. In accordance with the invention, the features mentioned above and those further specified may be used individually for themselves or in any combination of them. The embodiments shown and described are not to be understood as an exhaustive enumeration, but rather as exemplary character for the description of the invention

DETAILED DESCRIPTION

Figure 1:
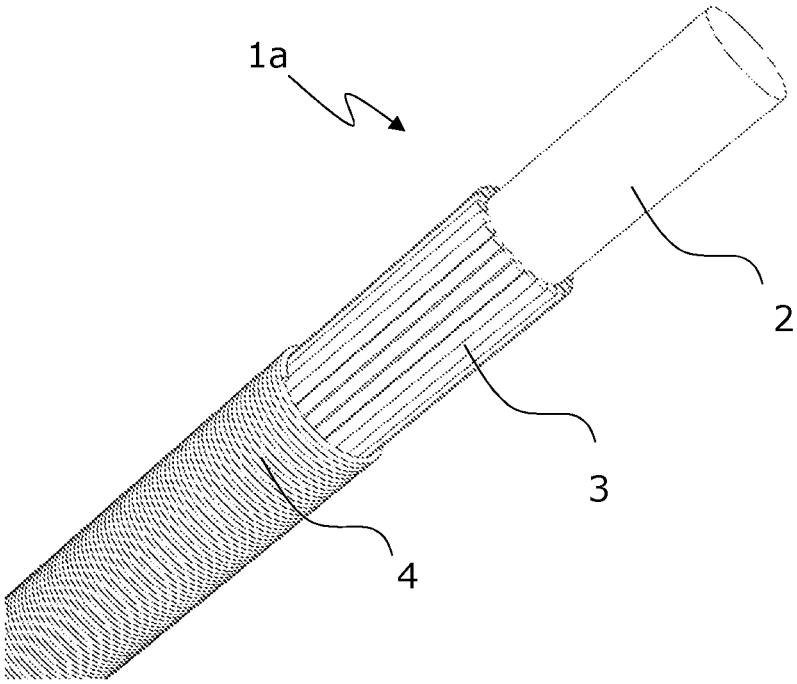
FIG. 1 shows a perspective view of a superconducting wire according to the invention with a first cladding comprising reinforcement strands aligned parallel to the core strand and a second cladding with a spirally wound further strand.
Figure 2:
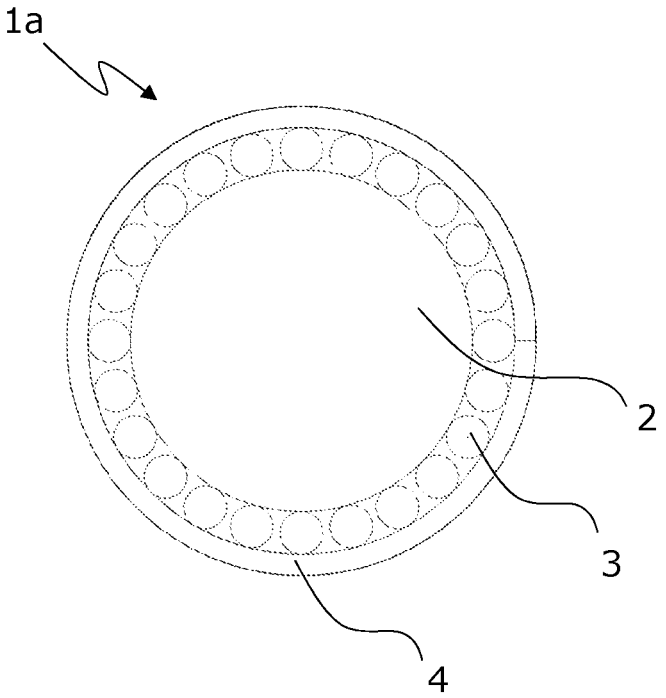
FIG. 2 shows a cross sectional view of the superconducting wire shown in FIG. 1.

FIG. 1 and FIG. 2 show a superconducting wire 1*a* with a core strand 2 (here: single solid core) surrounded by a multitude of thinner non-superconducting reinforcing strands 3. The reinforcing strands 3 form a first cladding, which is in direct contact with the surface of the core strand 2. The reinforcing strands 3 of the first cladding are parallel to the core strand 2, i.e. aligned with the core strand 2 at an angle $\alpha=0°$ and evenly distributed around the surface of the core strand. A further cladding (second cladding) is provided surrounding the first cladding and keeping the first cladding in place. The second cladding comprises a further strand 4 spirally wound around the first cladding. The further strand 4 of the second cladding and the core strand 2 confine an angle $\beta$ near to 90°. If smaller angles $\beta$ are chosen, more than one further strand is required to form the second cladding.

Figure 3:
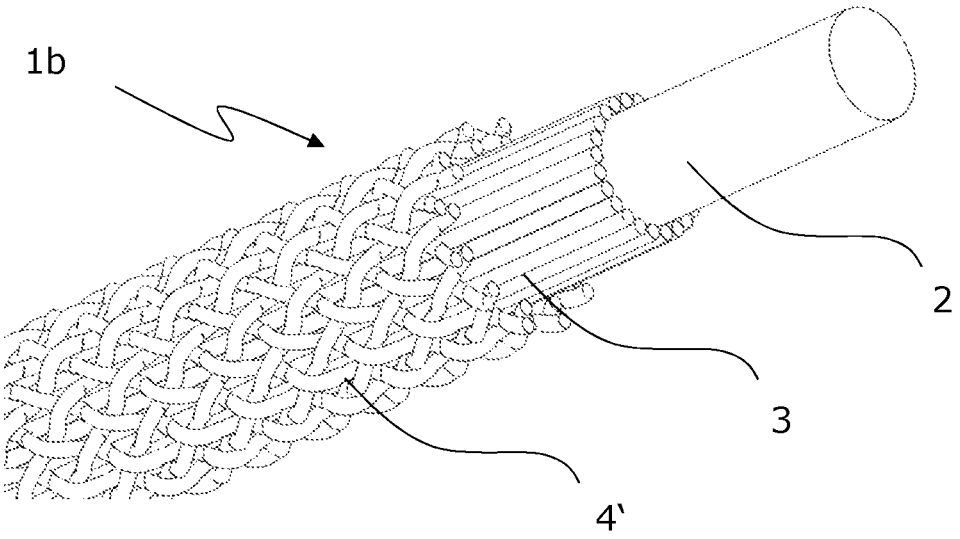
FIG. 3 shows a perspective view of a superconducting wire according to the invention with a first cladding comprising reinforcement strands aligned parallel to the core strand and a second cladding with braided further strands.
Figure 4:
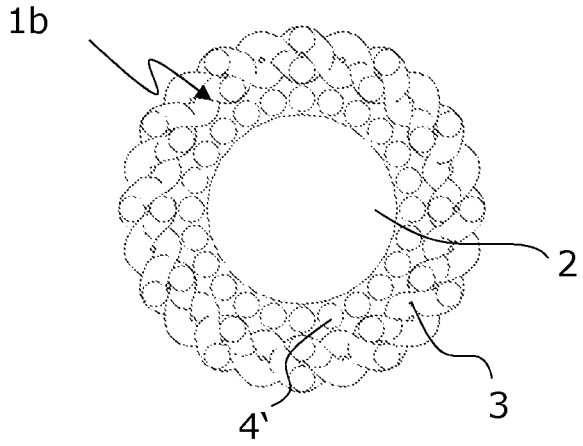
FIG. 4 shows a cross sectional view of the superconducting wire shown in FIG. 3.

FIG. 3 and FIG. 4 show another embodiment of the inventive superconducting wire. Instead of a spirally wound further strand 4, the second cladding comprises braided further strands 4'.

Figure 5:
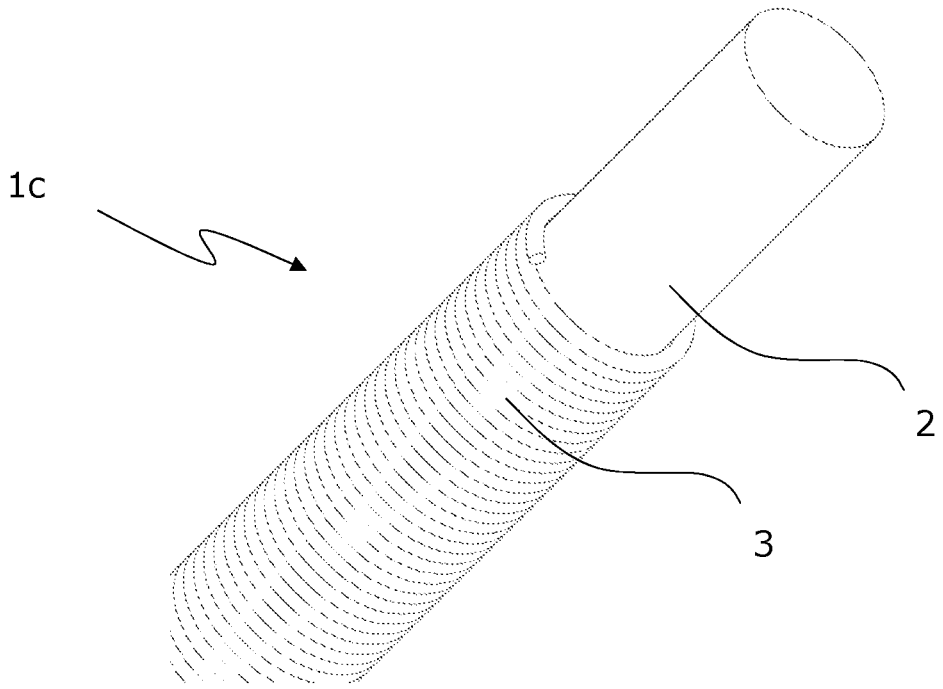
FIG. 5 shows a perspective view of a superconducting wire according to the invention with a first cladding comprising reinforcement strands spirally wound around the core strand.
Figure 6:
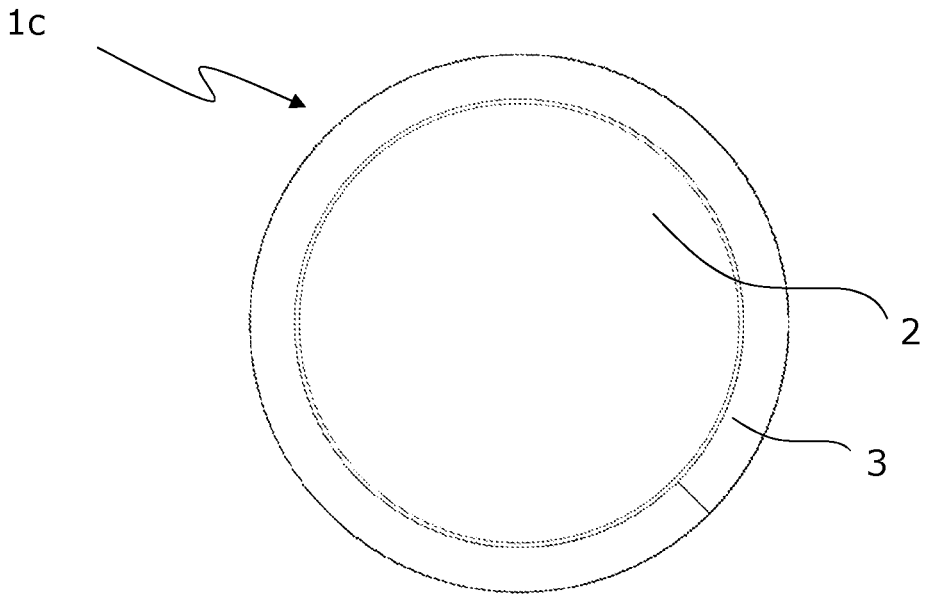
FIG. 6 shows a cross sectional view of the superconducting wire shown in FIG. 5.

FIG. 5 and FIG. 6 show another embodiment of the inventive superconducting wire 1*c* where a reinforcement strand 3 of the first cladding is spirally wound around the core strand 2. No second cladding is required to keep the first cladding in place.

In order to tune the radial and longitudinal reinforcement, different cross sectional dimensions of the reinforcing strand(s) 3 of the first cladding and of the further strand(s) 4, 4' of the further cladding can be chosen. FIG. 1 and FIG. 2 for example show an embodiment of the inventive superconducting wire with reinforcing strands having a larger diameter than the further strands.

An aspect of the present invention, according to one formulation is to coat the superconducting core strand 2 with a reinforcement cladding in order to increase the ability of the superconducting wire 1*a*, 1*b*, 1*c* to resist forces acting, e.g., in a magnet. According to the invention, thin reinforcement strands 3 are distributed around the circumference of the core strand and are aligned along the core strand 2. To hold the reinforcement strands 3 of the first cladding in place, a second cladding of other thin strands 4, 4' can be provided. In this case, the superconducting wire 1*a*, 1*b*, 1*c* is also resistant to radial compression. The reinforced superconducting wire 1*a*, 1*b*, 1*c* can be easily wound into coils, reacting at high temperatures and then impregnated, if required.

The present invention improves the mechanical properties of superconducting wires and superconducting cables comprising a superconducting core strand vis-à-vis those known conventionally by sheathing them in accordance with the invention. Such superconducting wires and superconducting cables can be used, e.g., in magnetic or energy transportation applications (e.g. Rutherford cables with several numbers of strands or, in the other extreme, in the simplest form, a few twisted strands). The invention is used most advantageously when it comes to withstand forces, e.g. in cabling for energy transport due to the strong forces between the strands or when the conductor/cable is pulled for some reason.

The inventive method allows the reinforcement to be matched/tuned in terms of strength of the reinforcement as well as of type of the reinforcing (longitudinal or radial) by selecting and combining respective materials and by choosing the alignment angle between superconducting strand and reinforcing strands.

LIST OF REFERENCE SIGNS

1*a*, 1*b* superconducting wire
2 superconducting core strand
3 reinforcement strands forming the first cladding
4 further strand forming the second cladding
4' braided strands forming the second cladding

LIST OF LITERATURE

[01] U.S. Pat. No. 6,534,718 B1
[02] K. Watanabe et al "Ag-sheathed Bi2Sr2CaCu2O8 square wire insulated with oxidized Hastelloy fiber braid" AIP Conference Proceedings 986, 439 (2008),
[03] US 2014/0296077
[04] US 2001/0055780 A1
[05] CN203787146 U
[06] U.S. Pat. No. 5,214,243
[07] U.S. Pat. No. 2,111,409
[08] U.S. Pat. No. 5,593,524
[09] U.S. Pat. No. 5,796,043
[10] CN1658343A

What is claimed is:

1. Superconducting wire comprising:
a superconducting core strand that has a circumferential surface, and
a first cladding consisting essentially of at least one non-superconducting reinforcing strand,
wherein the at least one reinforcing strand is arranged around the circumferential surface of the superconducting core strand in a non-crossing manner, and wherein the at least one reinforcing strand is in contact with the core strand.

2. Superconducting wire according to claim 1, wherein the at least one reinforcing strand of the first cladding is spirally wound around the circumferential surface of the superconducting core strand.

3. Superconducting wire according to claim 1, wherein the first cladding layer consists essentially of plural reinforcing strands arranged parallel to each other.

4. Superconducting wire according to claim 1, wherein the at least one reinforcing strand is aligned along the core strand at an angle to the core strand no greater than 10°.

5. Superconducting wire according to claim 4, wherein the at least one reinforcing strand is aligned along the core strand at an angle $\alpha=0°$ to the core strand.

6. Superconducting wire according to claim 1, wherein a diameter of the at least one reinforcing strand of the first cladding is less than a diameter of the superconducting strand.

7. Superconducting wire according to claim 1, further comprising at least one further cladding surrounding the first cladding, wherein the further cladding comprises at least one further strand which is oriented obliquely to the at least one reinforcing strand of the first cladding.

8. Superconducting wire according to claim 7, wherein the at least one further strand is oriented at an angle $\beta$ to the superconducting core strand, with $\beta>\alpha$.

9. Superconducting wire according to claim 7, wherein the first cladding comprises plural reinforcing strands of different cross sectional dimensions and/or the further cladding comprises plural further strands of different cross sectional dimensions.

10. Superconducting cable comprising at least two superconducting wires, each of the superconducting wires being configured according to claim 1.

11. Superconducting coil comprising a superconducting cable according to claim 10.

12. Superconducting coil comprising a superconducting wire according to claim 1.

13. Superconducting magnet comprising a superconducting coil according to claim 12.

14. Superconducting wire comprising:
a superconducting core strand that has a circumferential surface, and
a first cladding comprising at least one non-superconducting reinforcing strand,
wherein the at least one reinforcing strand is arranged around the circumferential surface of the superconducting core strand in a non-crossing manner, wherein the at least one reinforcing strand is in contact with the core strand, and wherein the at least one reinforcing strand of the first cladding is made from carbon fibers.

15. Superconducting wire comprising:
a superconducting core strand that has a circumferential surface, and
a first cladding consisting essentially of a plurality of non-superconducting reinforcing strands,
wherein the reinforcing strands are arranged around the circumferential surface of the superconducting core strand without overlapping one another and so as to each directly contact the core strand.

16. Method for producing a reinforced superconducting wire according to claim 1, comprising:
a) producing the superconducting core strand,
b) sheathing the core strand with the first cladding,
wherein said sheathing comprises attaching a single one non-superconducting reinforcing strand or plural non-superconducting reinforcing strands to the superconducting core strand around the circumferential surface of the superconducting core strand in a non-crossing manner, wherein the single reinforcing strand is or the plural reinforcing strands are in contact with the core strand.

17. Method according to claim 16, wherein said sheathing comprises attaching plural carbon fiber reinforcing strands to the superconducting core strand.

18. Method according to claim 16, wherein the first cladding is formed by spirally winding the at least one reinforcing strand around the circumferential surface of the superconducting core strand.

19. Method according to claim 16, wherein the first cladding is formed by aligning the at least one reinforcing strand along the core strand at an angle $\alpha$ to the superconducting core strand no greater than 10°.

20. Method according to claim 16, further comprising:
c) jacketing the circumferential surface of the first cladding with at least one further cladding, wherein the further cladding comprises at least one further strand.

21. Method according to claim 20, wherein the at least one further cladding is formed by twisting or braiding, or is woven of the at least one further strand over the first cladding.

22. Method according to claim 20, wherein the further cladding is formed by spirally winding the at least one further strand around the circumferential surface of the first cladding.

* * * * *